US007862525B2

(12) United States Patent
Carkner et al.

(10) Patent No.: US 7,862,525 B2
(45) **Date of Patent: *Jan. 4, 2011**

(54) AUTOMATED THERAPY DEVICE FOR BIOMECHANICAL REHABILITATION MASSAGE AND METHOD FOR USE

(76) Inventors: Steve Carkner, 107 Lockhart Ave., Ottawa, Ontario (CA) K2A 3R4; Jamie Risk, 2-2487 Falcon Ave., Ottawa, Ontario (CA) K1V 8C8; Leonid Blyum, 12 A, Demokritou St., Potamos Yermasoya, Limassol (CY) 4041

( * ) Notice: Subject to any disclaimer, the term of this patent is extended or adjusted under 35 U.S.C. 154(b) by 1347 days.

This patent is subject to a terminal disclaimer.

(21) Appl. No.: 11/306,263

(22) Filed: Dec. 21, 2005

(65) Prior Publication Data

US 2008/0188782 A1 Aug. 7, 2008

Related U.S. Application Data

(60) Provisional application No. 60/641,015, filed on Jan. 4, 2005.

(51) Int. Cl.
*A61H 7/00* (2006.01)

(52) U.S. Cl. ..... 601/151; 601/150; 601/152

(58) Field of Classification Search ..... 601/41, 601/44, 148–152; 606/201–203
See application file for complete search history.

(56) References Cited

U.S. PATENT DOCUMENTS 4,133,306 A * 1/1979 Berry ..... 601/150
5,490,820 A * 2/1996 Schock et al. ..... 601/41
5,649,954 A * 7/1997 McEwen ..... 606/202
6,468,237 B1 * 10/2002 Lina ..... 601/150
6,656,141 B1 * 12/2003 Reid ..... 601/134
6,736,787 B1 * 5/2004 McEwen et al. ..... 601/152
7,074,177 B2 * 7/2006 Pickett et al. ..... 600/17
7,076,993 B2 * 7/2006 Cook ..... 73/49.2
2002/0107461 A1 * 8/2002 Hui ..... 601/149
2006/0111655 A1 * 5/2006 Cook et al. ..... 601/151

* cited by examiner

*Primary Examiner*—Quang D Thanh
(74) *Attorney, Agent, or Firm*—Gordon Thomson

(57) ABSTRACT

An automated massage device for biomechanical rehabilitation massage for use on CP patients comprises at least one inflatable bladder with inflation means adapted to provide compressive forces against the body to stimulate smooth muscles in a controlled manner. The device includes a programmable controller that is able to receive instructions on a dynamic prescriptive basis from a professional therapist and then relay these instructions to a care-giver in a home situation. The instructions include the placement of the bladder, the duration of the massage and the sequence of body locations to receive massage therapy. Once the bladder is placed in the required position against the body the device will execute the prescribed massage therapy for that location and then cue the care-giver to move the bladder to the next body location in the prescribed sequence. The prescription is time limited and once expired renders the device inoperable to prevent over application of the massage therapy.

16 Claims, 9 Drawing Sheets

52
55
50
57

56

58

Figure 4
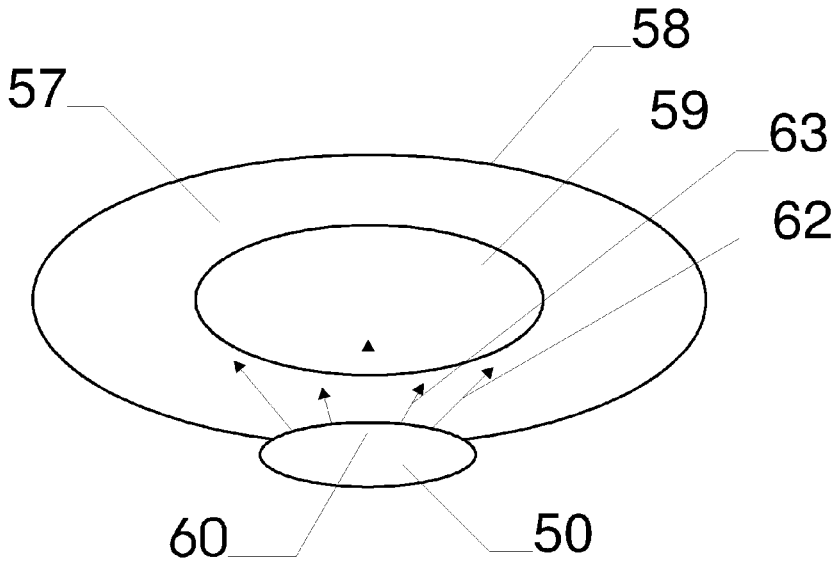
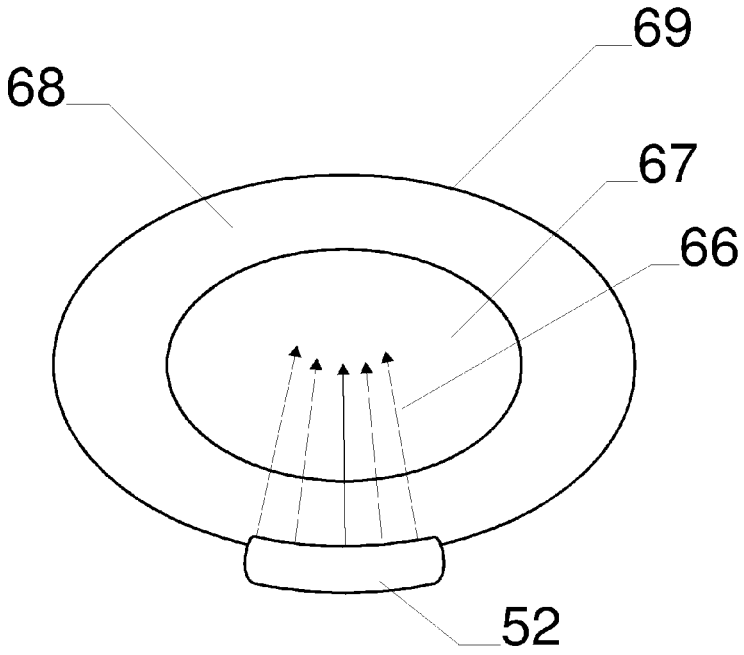
Figure 5

AUTOMATED THERAPY DEVICE FOR BIOMECHANICAL REHABILITATION MASSAGE AND METHOD FOR USE

This invention relates to massage devices and in particular to an apparatus for the treatment of a living human body and specifically to an automated massage therapy device for biomechanical rehabilitation massage and method of use for the stimulation of smooth muscles and internal myofascia in persons suffering from cerebral palsy (CP) or other disorders that may result in the smooth muscles of the body suffering from atrophy and the general degradation of the myofascia inside the body.

BACKGROUND OF THE INVENTION

Cerebral Palsy (CP) is a term used to describe a group of disorders affecting body movement and muscle co-ordination. The medical definition of cerebral palsy is a "non-progressive" but not unchanging disorder of movement and/or posture, due to an insult to or anomaly of the developing brain. Development of the brain starts in early pregnancy and continues until about age three. Damage to the brain during this time may result in CP. This damage interferes with messages from the brain to the body and from the body to the brain. The effects of CP vary widely from individual to individual. At its mildest, CP may result in a slight awkwardness of movement or hand control. At its most severe, CP may result in virtually no muscle control, profoundly affecting movement and speech. Depending on which areas of the brain have been damaged, one or more of the following may occur: muscle tightness or spasms, involuntary movement, difficulty with "gross motor skills" such as walking or running, difficulty with "fine motor skills" such as writing or doing up buttons.

These effects may cause associated problems such as difficulties in feeding, poor bladder and bowel control, breathing problems, and pressure sores. The brain damage which caused CP may also lead to other conditions such as: seizures, learning disabilities or developmental delay.

CP is not a progressive condition—damage to the brain is a one-time CP event so it will not get worse—and people with CP have a normal lifespan. Although the condition is not progressive, the effects of CP may change over time. Some may improve: for example, a child whose hands are affected may be able to gain enough hand control to write and to dress him/herself. Others may get worse: tight muscles can cause problems in the hips and spine of growing children which require orthopedic surgery; the aging process can be harder on bodies with abnormal posture or which have had little exercise.

Treatment programs are tailored to individual needs and vary as new medical issues develop. Muscle stimulating physical and occupational therapies are important because they increase both muscle strength and tone and prevent disuse atrophy. A number of known art devices exist to stimulate muscle action but these devices and therapies almost exclusively focus on the skeletal muscles. Skeletal muscles are also called voluntary muscles because they can be controlled. Examples would include the biceps which are used when lifting an object. Voluntary muscles may be stimulated by Transcutaneous Electrical Nerve Stimulation (TENS) or by moving the bones they are connected to.

Treatment programs generally ignore the smooth muscles of the body also called the involuntary muscles and the internal myofascia surrounding these muscles. The myofascia covers, supports and separates muscles. Each muscle fiber is wrapped with myofascia, bundles of those fibers are wrapped with myofascia, and the whole muscle is also wrapped in myofascia. Myofascial tissue is dynamic: under strain it increases in density and relative rigidity, giving the muscles more support.

Many of these muscles are used for tasks in the body that require no thought in daily life such as digestion and focusing your eyes. A number of these muscles are also used to stabilize the body. When these smooth stabilization muscles become weak, the posture, form and mobility of the body are compromised and the skeletal structure itself may begin to collapse. These muscles are often deep inside the body and are therefore impossible to reach with conventional TENS or joint-action based therapies.

In individuals with CP or similar disorders, the smooth stabilization muscles and internal myofascia may become weak because they are not challenged or directly addressed in daily life. For example, a child who has no control over his back muscles may also suffer from improperly developed back stabilization muscles and associated myofascia which in turn leads to a weakening of the entire body structure.

Advanced Biomechanical Rehabilitation (ABR) has been used for more than a decade to coax the smooth stabilization muscles, internal myofascia and related structures to react to forces applied to the body by a care-giver's massage. This therapeutic massage is performed by applying force to specific regions of the body using the hands. Four critical parameters of the massage are:

The force must be applied evenly over the whole surface of the hand with no high or low pressure points using a motion that is piston-like in that it can push into the body and be withdrawn from the body in smoothly controlled movements.

The force must be applied very gradually, increasing slowly to a peak, hold the pressure, then gradually reduce the pressure. This ensures the force reaches the smooth muscles and internal myofascia deep within the body and gives them time to react. Applying the massage improperly will cause the contraction of the muscles in the exterior regions of the body which will therefore absorb part of the forces being applied instead of allowing them to pass deeper into the body. This diminishes the effectiveness of the massage treatment since the forces are diluted in the exterior muscles and myofascia.

The massage is made up of pressure cycles. Each individual pressure cycle will have an effect on the body. The massage is therefore effective from the very first application of pressure. However, the individual effects are very small, a large number of pressure cycles may therefore be required to see the benefits of the massage. It is the summation of the effects of all the pressure cycles that is most important, the overall number, duration and application of the pressure cycles may be varied as the massage progresses to ensure the appropriate application for maximum benefit. In some cases the massage will be applied for thousands of hours over the course of years, in other cases the total massage time may be only a few hundred hours.

The massage will be applied at various locations around the body. Those areas in need of treatment are accessed by the professional at a clinic. There are no specific areas of the body that will always require treatment, and similarity there are no areas of the body that never require treatment. The effects of CP vary from person to person, and so too will the application of the massage.

It is extremely difficult for care-givers to learn the proper technique to apply the ABR massage and to find the time to consistently apply the massage for hundreds and sometimes thousands of hours over the course of treatment. A mechanized method of performing a therapeutic massage is therefore desired.

One example of a therapeutic massage device is described in U.S. Pat. No. 4,838,263 entitled "Chest Compression Apparatus" issued to Warwick et al on June 13, 1989. The 263 patent describes a device comprising a vest-type bladder covering the chest of the individual and means for inflating and deflating the vest. The application of pressure pulses and the pulse rate is controlled by the individual. The pressure pulses are designed to be very quick and strong to dislodge mucus from the lungs. There is no need for precise control over pressure, distribution of force, or number of pressure cycles. Another example of the known art is described in U.S. Pat. No. 6,471,663 issued to Brunt and Gagne on Oct. 29, 2002 and entitled "Chest compression vest with connecting belt. The 663 patent includes an inflatable bladder that is wrapped around the chest of the individual. The bladder is inflated using compressed air and then deflated. The 663 patent describes an uncomfortable and intrusive device. It does not address the requirement for following a precise and therapeutic application of massage that could be used to strengthen muscles.

Therefore there exists in the known art of massage therapy devices shortcomings relating to the size of the apparatus, the ability of the apparatus to correctly apply the massage therapy with the required methods and parameters and the comfort of the apparatus and the trouble that an individual or care-giver may have in the self-application of a precise therapeutic regime as prescribed by a professional. There also exists a need to monitor the massage therapy to ensure that it is being properly applied and not over-applied by unskilled caregivers who are sometimes of the belief that if a little massage therapy is good, then more must be better.

SUMMARY OF THE INVENTION

In a preferred embodiment of the invention there is provided an automated massage therapy device comprising bladders, a belt for placing and holding the bladders next to the body, bladder inflation means, bladder deflation means, a control consol and a programmable controller. The device is designed for in-home use by an unskilled care-giver. As well, the device is designed to be programmed by a professional on a dynamic prescriptive basis.

The bladder inflation means, bladder deflation means and programmable controller are contained within a closeable case adapted for easy transport and convenient use. In use, the bladders are connected to the inflation and deflation means by flexible conduits. The bladders are removably fixed to the belt and against the body in therapeutically determined and prescribed positions. When not in use, the bladders, belt and conduits can be stored in the case. The control consol includes visual displays including a front of human body silhouette with LEDs located in therapeutically effective positions to instruct the care-giver where to place the bladders on the body and the sequence of body parts to receive the massage. As well the control consol includes a visual display capable to relaying written instructions and prompts to the care-giver to ensure that the prescribed massage is executed properly. In another embodiment of the invention audible instructions can be programmed into the device. In yet another embodiment of the invention the human body silhouette includes both a front and back of body silhouette or may be shown on a graphical display such as a liquid-crystal display.

More specifically the device comprises: an air intake, a first particulate filter, a pressurizing pump, a first solenoid operated valve, a second particulate filter all for inflating a first bladder and a second bladder. To deflate bladders there is: a needle orifice, a vacuum pump and an optional second solenoid operated valve. A pressure gauge monitors system pressure to avoid overpressure situations. The bladders are cored with foam and are designed to be placed next to the body of the individual during massage treatment and apply pressure to the body by inflating and maintaining an inflated state for a predetermined period of time. During inflation and deflation the bladders maintain their shape to ensure an effective application of pressure to the body. The needle orifice acts as protection against over pressurization. There is also a manual emergency shutdown system that can be activated by the care-giver by a push button mounted to the control consol of the device. The emergency shutdown system will cut power to either the pressurizing pump or vacuum pump as appropriate.

When the bladders are being deflated, the pressurizing pump is shut off and the first solenoid valve is closed to prevent leakage into the bladders through the pump. The optional second solenoid valve is opened and the vacuum pump is activated to draw the air from the bladders through the needle orifice. The needle orifice has a small diameter of 0.026 inches and a length of 0.75 inches. The needle orifice sets the minimum bladder deflation rate even if the vacuum pump is switched off.

During use, the bladders are placed on the body using directions from a body silhouette on the control panel of the device. The body silhouette contains LEDs which illuminate in sequence to determine the body part to be treated and the sequence of body parts to be treated during a course of massage therapy. Once the bladders are placed on the body by the care-giver in the proper place as identified by the body silhouette on the consol, the care-giver is prompted by the visual display to execute the massage program. During the program, the bladders are inflated to a maximum predetermined therapeutic pressure using a specific pressure profile, and held for a predetermined time both of which are prescribed by a professional. The bladders may be repeatedly inflated and deflated during a course of the massage (pressure cycles) to create a stimulating and strengthening effect on specific smooth muscles and associated myofascia. The number of prescribed pressure cycles at a specific body location is programmed into the device by way of a programmable controller. The device is adapted for use for in-home massage therapy by a non-professional care-giver such as a parent. When the prescribed massage program has finished, the device will be rendered inoperative so that the care-giver is not able to provide more massage therapy than prescribed. The duration of the prescribed massage program may be cycle based, that is the total number of massage cycles applied may not exceed a prescribed number, or it may be time based and set for expiry after, say for example, 30 days of following the prescribed program. After the prescription is completed, the device will also prompt the care-giver to return the individual with device to the prescribing professional for reassessment and a revised prescribed massage program. As well, the device monitors the application of the prescribed massage program so that on reassessment the professional can determine whether or not the prescribed program was followed. In situations where the prescribed massage program can be repeated, the device is able to receive a new prescription electronically over the telephone or an Internet connection by way of an USB port. As well, the device is able to be programmed by a flash memory device received by mail.

The belt has a variety of lengths to suit the placement of the bladders on limbs and torsos. The belt includes a label with a linear strip of sequential numbers on one end. When the belt is fastened to the body, the opposite end of the belt will indicate a specific number on the linear strip. In this way, if the care-giver wishes to tighten the belt to a desired degree on a repeatable basis the appropriate number on the linear strip is aligned with the opposite end of the belt.

The bladders have a foam core to help retain their preferred shape whether inflated or deflated. In another embodiment of the invention, the foam core comprises a layer of stiffer higher density foam over a layer of lower density form. The VELCRO® on the bladder is adhered to the side of the bladder having the denser foam for better support and stability during repeated pressure cycles. The foam cores are sealed within an envelope of an air tight material.

To fit the varied shapes and locations on the human body the bladders may address several complex geometric configurations including shapes which are flat, ridged and curved to fit specific areas of the body. The construction of such complex shaped bladders is similar to the preferred regular shaped bladders which are outlined in this document for simplicity. It is expected that flat bladders as shown in this preferred embodiment will address the most common massage locations but specific complex shapes may be required for specific individuals or massage locations.

In one embodiment of the invention, the device is able to control one set of two bladders acting cooperatively.

In another embodiment of the invention, the device is able to control two sets of two bladders acting independently. These bladders may be placed in different locations on the body, or they may be stacked on top of each other to allow the force from said bladders to be modulated and focused using the combination of multiple bladders acting together on one specific location of the body.

A method of using an automated massage therapy device for biomechanical rehabilitation comprises the steps of: providing a medical facility including professionals skilled in therapeutic massage therapy; placing an individual in need of therapeutic massage therapy in association with the professionals; assessing the therapeutic massage therapy needs of the individual by the professionals; determining the sites of therapeutic massage on the body of the individual with reference to a body silhouette having a plurality of generalized massage sites indicated thereon; determining the number of massage cycles to be applied at each of the massage sites; determining the number of massage cycle sets to be applied at each of the massage sites; determining the sequence of the body sites of therapeutic massage to receive massage therapy thereby creating a massage regime; determining number of repetitions of said massage regime per day thereby creating an individualized massage program; determining the duration of the individualized massage program in days thereby creating a prescription; disabling the device at the expiry of the prescription; and, instructing the individual to return with the device to the medical facility for reassessment. Determinations are programmed into the device as a prescription for execution by the care-giver.

OBJECTS AND ADVANTAGES OF THE INVENTION

It is an object of the present invention to provide an automated massage therapy device for biomechanical rehabilitation massage that can be used in at-home situations.

Another object of the present invention is to provide an automated massage therapy device for biomechanical rehabilitation massage that can be used by a care-giver with little technical or medical training.

Still another object of the present invention is to provide an automated massage therapy device for biomechanical rehabilitation massage that can be programmed with a course of massage therapy on a dynamic prescription basis.

Yet another object of the present invention is to provide an automated massage therapy device for biomechanical rehabilitation massage that prevents an over application or under application of massage therapy by the care-giver.

A further object of the present invention is to provide an automated device for biomechanical rehabilitation massage that is compatible with manual massage methodologies.

Still further objects and advantages of our invention will become apparent from a consideration of the following diagrams and detailed description.

DESCRIPTION OF THE DRAWINGS

FIG. 4 shows the force distribution on a body by the rubber bladder of FIG. 2B.

FIG. 5 shows the force distribution on a body by the laminated bladder of FIG. 3B.

DETAILED DESCRIPTION

System Design

Figure 1:
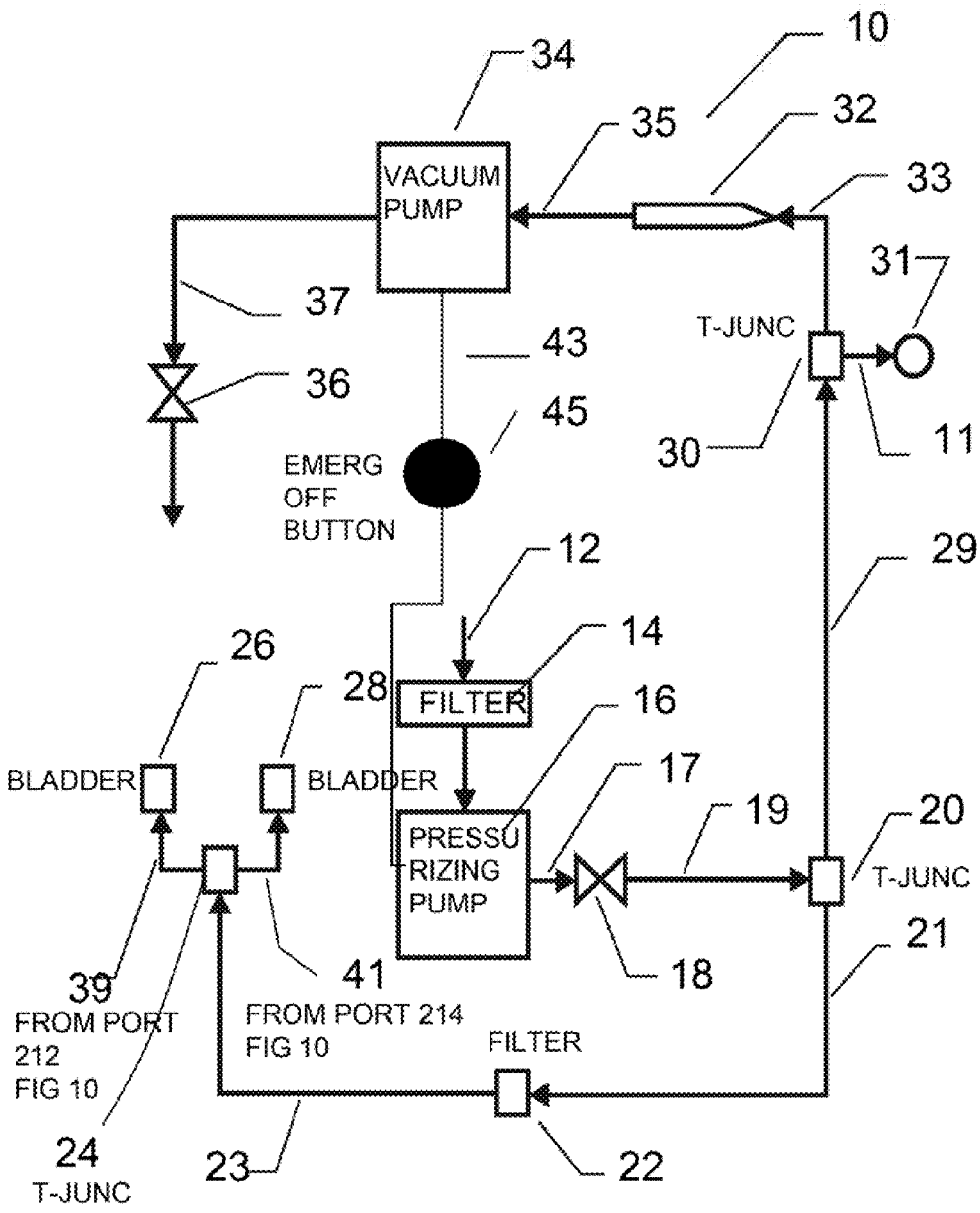
FIG. 1 is a schematic diagram of the air flow of our invention.

Now referring to FIG. 1 there is shown a schematic diagram of the air flow in a preferred embodiment of the system our invention (10). Our invention is designed to exercise and strengthen smooth muscles and their associated myofascia by the application of at least one therapeutically effective pressure cycle on at least one area of the human body using at least one actuator which provides a piston-like action against the body by pressing into the body with an evenly distributed force, then withdrawing from the body in a smoothly controlled manner using an air-filled bladder as the actuator. The following components of the system are identified as follows: air intake (12), first particulate filter (14), pressurizing pump (16), pressurizing pump exhaust conduit (17), first solenoid operated valve (18), first solenoid valve outlet conduit (19), first T-junction (20), conduit (21), second particulate filter (22), conduit (23), second T-junction (24), conduit (39), first bladder (26), conduit (41), second bladder (28), conduit (29), third T-junction (30), conduit (11), pressure sensor (31), conduit (33), needle orifice (32), conduit (35), vacuum pump (34), conduit (37) and optional second solenoid operated valve (36). The preferred embodiment system operates at 12 VDC and a current of 2 A but other voltages and currents are possible. The bladders are adapted to be placed next to the body of the individual during a prescribed course of massage therapy and apply pressure cycles to a specific area of the body by repeatedly inflating, holding at a maximum inflation pressure for a prescribed period of time and then deflating. The bladders are held against the body by a belt as further described herein. In operation, all components of the device except for the bladders and connecting conduits (39) and (41) are contained within a case adapted to protect the components as well as be light and easily stored. When not in operation, the bladders, belt and connecting conduits can also be stored within the case.

When the bladders are being pressurized, air is drawn into the system at air intake (12) through first particulate filter (14) and into pump (16). Particulate filter (14) is designed to trap dust and other debris that could reduce the life of pump (16). Pump (16) is a diaphragm pump driven by an electric motor. Pump (16) provides excellent control of the air volume delivered to the first and second bladders (26) and (28). The operating characteristics of pump (16) are chosen so that the maximum pressure in the system is restricted to less than 350 mm Hg (millimeters of mercury or TORR). In this manner there is no need for a safety valve as such pressures are well below the burst pressure of the bladder and conduits. The therapeutic effective pressure of the system is less than 100 mm Hg. Pump (16) can deliver air at a rate of 4 liters per minute. Pressurized air exhausted from pump (16) is delivered by way of conduit (17) to first solenoid valve (18) which has a first open position and a second closed position. Valve (18) is in its first open position when pump (16) is inflating the bladders (26) and (28) as more fully explained below. Valve (18) adopts a second closed position when the bladders are being deflated as more fully explained below. Pressurized air flows from valve (18) by way of conduit (19) to T-junction (20). From T-junction (20) pressurized air flows through conduit (21) to a second particulate filter (22). Second particulate filter (22) is optional and is intended to trap any dirt or debris that may come from the bladders themselves or inside the conduits leading to the bladders during deflation. Second particular filter (22) like first particulate filter (12) is intended to protect the pumps and valves of the system from failure. From second particulate filter (22) air flows to T-junction (24) through conduit (23) whereupon it is directed at equal pressures into conduits (39) and (41) and hence to pressurize inflatable bladders (26) and (28) to therapeutically effective pressures.

During bladder pressurization, air also flows from T-junction (20) through conduit (29) to T-junction (30) and air pressure sensor (31) by way of conduit (11). From T-junction (30) air flows towards the needle orifice (32) through conduit (33). The needle orifice will restrict the air flow and prevent air from leaving the device in volumes detrimental to bladder pressurization.

During bladder depressurization, air travels through conduit (35) to a vacuum pump (34). Exhaust from vacuum pump (34) travels through conduit (37) to an optional second valve (36). When the bladders (26) and (28) are at positive pressures greater than ambient pressure there will be some leakage of air through vacuum pump (34) by way of needle orifice (32). This leakage airflow is normally compensated by the air from pump (16). Needle orifice (32) will restrict air leakage so that the vast majority of the air from pump (16) will be directed into the bladders (26) and (28). Optional second valve (36) may be added to the system. In its closed position, optional second valve (36) will eliminate any air leakage and therefore marginally increases the efficiency of the system.

Needle orifice (32) also acts as protection against over pressurization. Airflow through an air restriction, such as an orifice, tube or needle will have a positive relationship with system pressure. The higher the pressure differential across the restriction the more air will flow through the restriction up to the point wherein laminar flow through the restriction becomes turbulent. In an air restriction device such as a needle orifice the flow may be laminar, turbulent, or a combination of the two. Laminar flow occurs from zero air flow up to some point determined by a number of factors including type of gas being pressurized, humidity, temperature and geometric description of the restriction. The principle feature of laminar flow is that the amount of air flow is proportional to the differential pressure. The onset of turbulent flow is marked by a departure from a strictly proportional change in flow rates. When turbulent flow occurs, an increase in gas pressure does not result in an increase in air flow volume.

Airflow through the system pumps has an inverse relationship to system pressure. The higher the pressure differential across the pump the less air that will flow through the pump. In this way the exact dimensions and performance of a restriction orifice can be chosen so that an insignificant amount of air will be lost through the orifice at normal therapeutic pressures of less than 100 mm Hg. Proper orifice choice ensures that all of the air delivered by the pump will escape through the orifice in the event of an overpressure situation caused by a system failure, for example, the pressurizing pump failing to switch off or loss of control by system controlling resulting in unsafe system pressures.

Pressure sensor (31) is calibrated to ambient pressure upon start-up and has an accuracy of typically 5%. The massage treatment protocol requires very gradual increases in pressure. Therefore, the pressure sensor has very high relative accuracy capable of measuring pressure steps smaller than 0.25 mm Hg.

There is also a manual emergency shutdown system (43) that can be activated by the care-giver by a button (45) located on the control consol shown in FIG. 5. The emergency shutdown system will cut power to either the pressurizing pump or vacuum pump as appropriate.

In the preferred embodiment of the invention conduits (11), (37), (17) and (19) are 85 A polyurethane with a diameter of 0.25 inches. Conduits (29), (35) and (33) are 85 A polyurethane with a 5/16 inch diameter. Conduits (21), (23), (39) and (41) are 70 A polyurethane with a 3/8 inch diameter.

System Operation

When the bladders (26) and (28) are being deflated, pump (16) is shut off and first solenoid valve (18) is closed to prevent leakage into the system through pump (16). The optional second solenoid valve (36) is opened and vacuum pump (34) is activated to draw the air from the bladders and exhaust air from the device through the needle orifice (32) by way of conduits (29), (33), (35) and conduit (37). The needle orifice has a small diameter of 0.026 inches and a length of 0.75 inches. The needle orifice sets the minimum bladder deflation rate even if vacuum pump (34) is switched off. When vacuum pump (34) is switched on it will create an increased pressure differential across the needle orifice (32). This pressure differential will generally increase as more power is fed to the vacuum pump (34). The maximum deflation rate is therefore limited either by the maximum power (and pressure) that vacuum pump (34) is rated to handle or by the flow rate at which the flow in the needle orifice becomes turbulent.

During a pressure cycle it is desirable to hold the bladders at predetermined and prescribed therapeutic pressures representing maximum and minimum pressure levels of the cycle. If the first valve (18) and optional second valve (36) are present in the system, pressure may be held steady by simply closing both valves and switching off pressurizing pump (16) and vacuum pump (34). In the event that optional second valve (36) is not present, or in the case where a small leak exists in the system (such as a pin-hole in one of the bladders), pump (16) may be operated to cycle automatically with valve (18) open to compensate for the pressure loss or vacuum pump (34) may be operated to cycle automatically in the case where the system is at negative pressure and air is leaking into the system.

The bladders may be repeatedly cycled from a minimum therapeutic pressure to a therapeutic maximum pressure at a predetermined frequency and for a predetermined duration to create the desired massaging effect and hence stimulate deep smooth muscle tissue within the body. The number of pressure cycles at a given position on the body and the duration of the periods of maximum and minimum pressure during each cycle are predetermined by a professional, and, as more fully explained below, are programmed into a programmable controller that is adapted to control all operational aspects of the device in accordance with the prescription. The prescription is easily changed to suit the needs of the massage therapy and so the prescription is determined to be dynamic.

Bladder and Belt Design

Figures 2A, 2B, 2C, 3A, 3B, 3C:
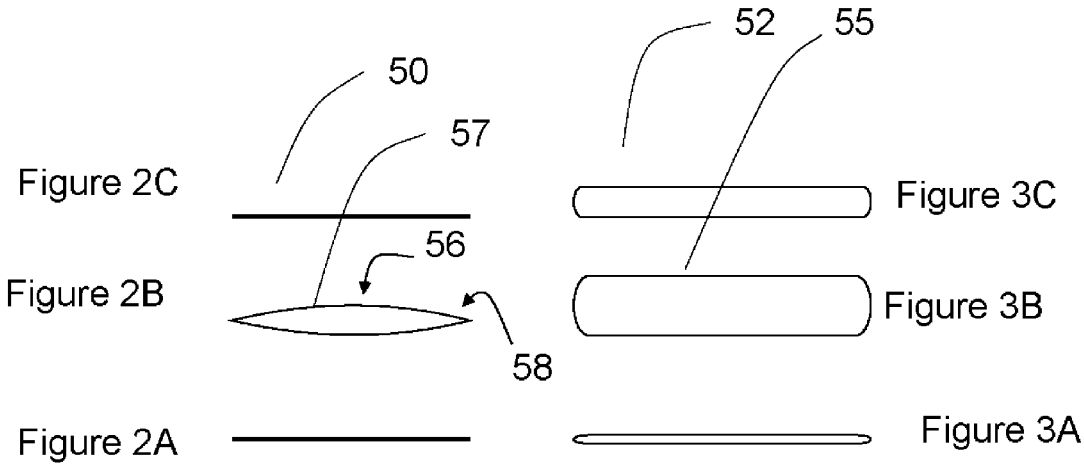
FIGS. 2A to 2C show cross-sections of a rubber bladder of a previous embodiment of the present invention.
FIG. 3A to 3C show cross-sections of the preferred laminated bladder of the present invention.

Referring now to FIGS. 2A to 2C, there is shown in cross-section a standard rubber bladder profile (50) having a first deflated profile (FIG. 2A) under a negative pressure (vacuum), a second inflated profile (FIG. 2B) and a third profile under ambient pressure (FIG. 2C). The standard rubber bladder (50) is one which is typically used in blood pressure cuffs and has a flat shape when deflated as shown in FIG. 2A and a lens shape when inflated as shown in FIG. 2B. This type of bladder has been used in a previous design of the present invention with limitations as described herein. The present invention overcomes these limitations. It can be seen that the profiles in FIG. 2A and FIG. 2C are the same and therefore the standard rubber bladder does not have the capacity to retain a desired shape when either under negative or ambient pressures. The bladder in FIGS. 2A-2C is therefore either pressing against the body with a positive force, or it is deflated and therefore not pressing against the body with a force beyond that exerted by the belt holding it in place.

Referring to FIGS. 3A to 3C there is shown in cross-section a laminated bladder profile of the bladder of the present invention (52). FIGS. 3A to 3C represent the laminated bladder under a negative pressure, inflation pressure and ambient pressure respectively. It can be seen that there is a distinct improvement in the manner in which the bladder of the present invention retains a desired shape over the standard bladder. The shape of the laminated bladder ensures that there is an equal application of pressure against the adjacent body across the entire contact surface (55) of the bladder whereas the contact surface of the standard bladder (57), as illustrated in FIG. 2B, will exert an uneven force profile against the adjacent body with a maximum pressure exerted in the middle of the contact surface (56) and minimum pressures exerted towards the edges of the bladder (58). When inflated to a maximum pressure the laminated bladder of the present invention undergoes a uniform change in thickness without any bulging, stretching or other gross mechanical changes that would cause the force profile against the adjacent body to be uneven. This is illustrated in FIG. 3B. The construction of the laminated bladder is detailed later. Under ambient pressure the laminated bladder maintains a flat profile. If the bladder were pressed against a rounded surface such as the chest of a human body, it would conform to the rounded surface, yet still maintain a fairly uniform thickness across the span of the bladder. Applying negative pressure to the laminated bladder causes it to become very thin, yet still with a uniform profile. This allows the entire dynamic range of the bladder thickness to be exploited. This provides a piston-like motion against the body. The surface of the bladder can exert an even force as it presses deeper into the body, and by deflation the bladder will withdraw from the body in an even fashion. The standard rubber bladder shows no significant change in thickness or profile under ambient (FIG. 2C) or negative pressure (FIG. 2A) situations.

For parts of the body with an irregular profile, a bladder with a similar irregular profile would be constructed. The foam core would be shaped to fit the desired body contour and the bladder would then provide a relatively even force profile to this irregular area of the body.

Referring to FIG. 4, if the standard rubber bladder (50) is placed against a human body (58) shown in cross-section. Bladder (50) will press into the body deepest in the middle where the bladder bulges (60). The forces exerted by the standard rubber bladder will therefore radiate out from the bladder into the body as shown by the force lines (62). This creates an uneven distribution of force on the adjacent surface of the body which causes the contraction of the exterior muscles of the body which will therefore absorb part of the force instead of allowing it to pass deeper into the body. This diminishes the effectiveness of the massage treatment. The forces are absorbed, as shown by the shortened force lines (63) in the exterior region of the body (57) which contains skeletal muscles and exterior myofascia, whereas the object of the invention is to penetrate deep into the interior body region (59) to act upon smooth muscles and internal myofascia in these areas.

Referring to FIG. 5, there is shown a similar application of a laminated bladder (52) of the present invention inflated and applying force against an adjacent human body (69). The laminated bladder presses into the body in a more even manner. By conforming to the curve of the body the forces exerted (66) by the bladder on the body are more focused and penetrate through the exterior region of the body (68) deep into the interior regions (67) which contain the mesh of smooth muscles and interior myofascia which is responsible for the core strength and stability of the body. This results in more therapeutic force being applied to the deeper smooth muscles of the body without having to increase the total force pressure applied to the bladder and the surface of the body which would result in discomfort and possibly bruising or other damage if the forces were too great.

Figure 6:
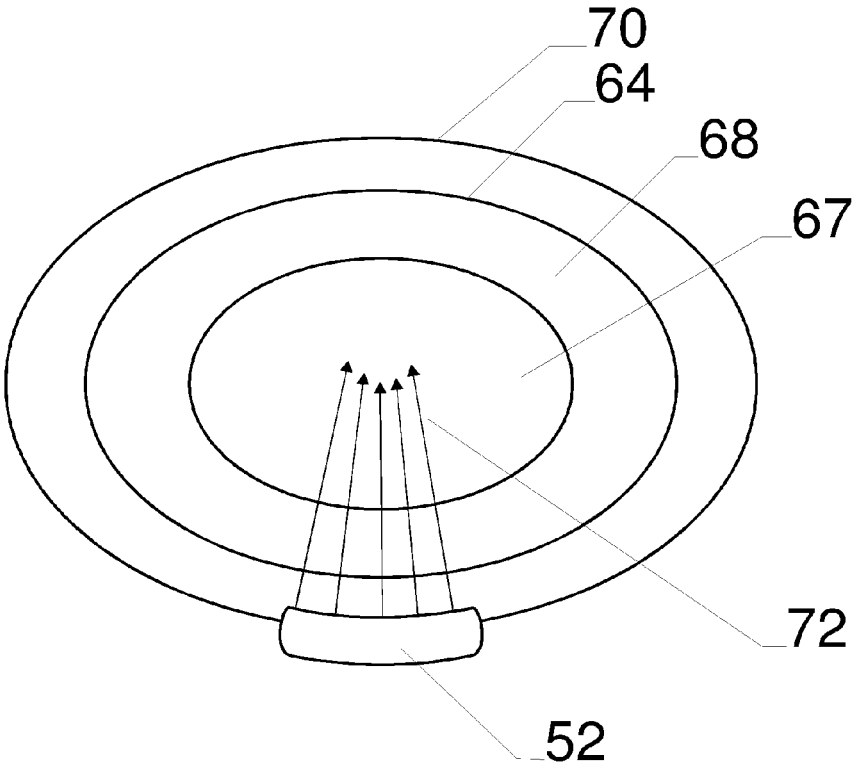
FIG. 6 shows the force distribution on a body by the laminated bladder of FIG. 3 with the bladder and body wrapped in a towel.

Refer now to FIG. 6. In manual or hand applied massage therapy towels or other products are often wrapped around the body to provide additional cushioning and to help focus the force of the hands deeper within the body. Applying this same principal to our invention, adding towels (70) around the body (64) will cause the forces (72) exerted by the laminated bladder (52) to continue to pass through the exterior regions of the body (68) and will be even more focused on the mesh of smooth muscles and internal myofaschia deep within the interior regions of the body (67) with improved therapeutic results. The focus of the forces works much like a magnifying glass can focus sunlight by varying the distance from the target. Therefore, one advantage of the present invention is satisfied in that the laminated bladder is compatible with the traditional manual or hand applied ABR treatment regimes.

Figures 7A, 7B:
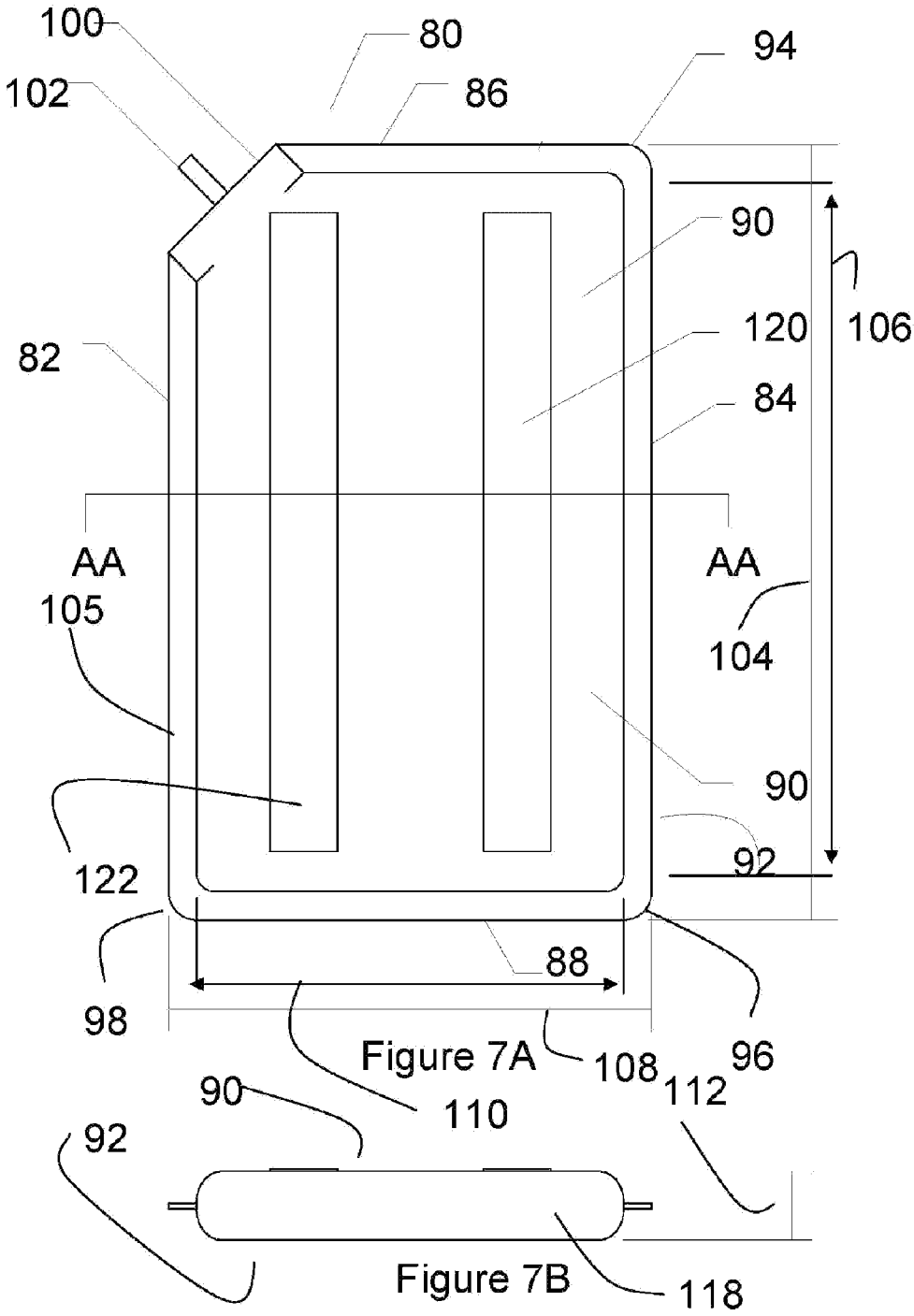
FIGS. 7A and 7B show a preferred embodiment of the bladder of the present invention.

Referring to FIGS. 7A and 7B, there is shown the construction of a typical bladder (80) of the present invention in a large size format. The view is of the bladder back face (FIG. 7A) and bladder cross-section at AA-AA (FIG. 7B). The bladder is available in three sizes: large, medium and small. The large bladder has an approximate air capacity of 100 ml. at 10 mm Hg. Without the internal foam core this bladder would require approximately 600 ml of air. In this way the foam core increases the efficiency and responsiveness of the system by reducing the air required to change the thickness of the bladder. Bladders can be constructed in any shape and could be customized to fit particular areas of the body. This may include the creation of a bladder with varying thickness in order to more accurately position the bladder and focus the force of the bladder on the exact muscle grouping that requires treatment. The preferred embodiment of the present invention uses a bladder having the simple shape shown in FIG. 7A and FIG. 7B as it can be used for a wide variety of body sizes and locations and it is easy to manufacture. The bladder has a left side (82), a right side (84), a top side (86), a bottom side (88), a front surface (92) and a back surface (90). The preferred shape of the bladder is substantially rectangular although upon inflation the three corners of the bladder (94), (96) and (98) will take a rounded configuration. The air connector plug (100) and air tube fitting (102) give the bladder a slightly polygonal appearance. In the preferred embodiment shown there is a single air tube fitting used to inflate and deflate the bladder. Pressure is sensed remotely. As the pressure in the bladder approaches the desired set point the flow rate of air being transferred to/from the bladder is reduced such that the pressure inaccuracy generated by the pressure drop in the connecting hose (FIG. 1 Items 39 and 41) will approach zero as air into or out of flow drops to zero. In another embodiment there may be two fittings installed the air plug to facilitate separate in and out air-flow and pressure sensing tubes. This allows swifter inflation and deflation of the bladders because the pressure differential inside the tubes feeding the bladder will not affect the pressure sensing and therefore flow rate into or out of the bladders does not need to be reduced until the desired pressure set point is reached.

Still referring to FIG. 7A and FIG. 7B the bladder has an outside length (104), and an inside length (106) with the difference made up by the seam (105). There is also an outside width (108), an inside width (110), and a thickness (112). The bladders have a nominal working pressure of minus 100 mm Hg to plus 100 mm Hg. and a burst pressure of about 300 mm Hg The front (92) and back (90) surfaces of the bladder are constructed from a hybrid cloth and plastic material which can trap air inside the bladder but presents a soft and non-abrasive cloth-like surface on the outside. The material is heat sealed around the perimeter of the bladder forming an overlapping sealed edge (105) which forms an airtight edge-boundary for the bladder. Within the bladder is a rectangular block of foam (118) that is able to accept pressurized air into its voids. The bladder is formed by taking two pieces of outer material and a suitably dimensioned block of foam and then covering the front and back surfaces of the foam block with the pieces of material. A sufficiently hot surface is then used to seal the edge (105) and this also seals the material to the foam itself. Advantageously, the foam rubber core of the bladder is sufficiently rigid to maintain the overall shape of the bladder when inflated and is pliable enough to conform to the body of the wearer. One corner of the rectangular bladder is then cut diagonally to insert the air plug (100) and fitting (102) combination. The air plug and fitting are then air-sealed using a suitable adhesive material. Alternatively the air plug may be molded into the bladders when they are first heat sealed. The plug is preferably a barb-type hose fitting that allows the user to attach any length hose of suitable diameter between the bladder and the massage unit. The plug itself may be eliminated and replaced with a hose of fixed length that is permanently attached to the bladder. The dimensions for the large, medium and small bladders are, respectively, in centimeters:

(1) Outer length: 25, 20, and 15;
(2) Outer width: 16, 14 and 12
(3) Thickness: 2 for all sizes.

However, in other embodiments of the present invention other dimensions can be used. Multiple shapes and sizes can also be used in various combinations to provide exactly the right focus and effect of the massage.

Still referring to FIGS. 7A and 7B, a pair of parallel VELCRO® hook strips (120 and 122) is horizontally fixed to the back surface (90) of the bladder. The strips are employed to fix the bladder removably to a belt that positions them on the body. The Velcro® strips could be replaced by any number of fixing means both removable such as snaps or hooks, or permanent methods such as glue, thermal bonding or stitches. In higher production volumes the bladder and belt themselves could be formed out of the same materials as one homogenous unit.

Figure 8:
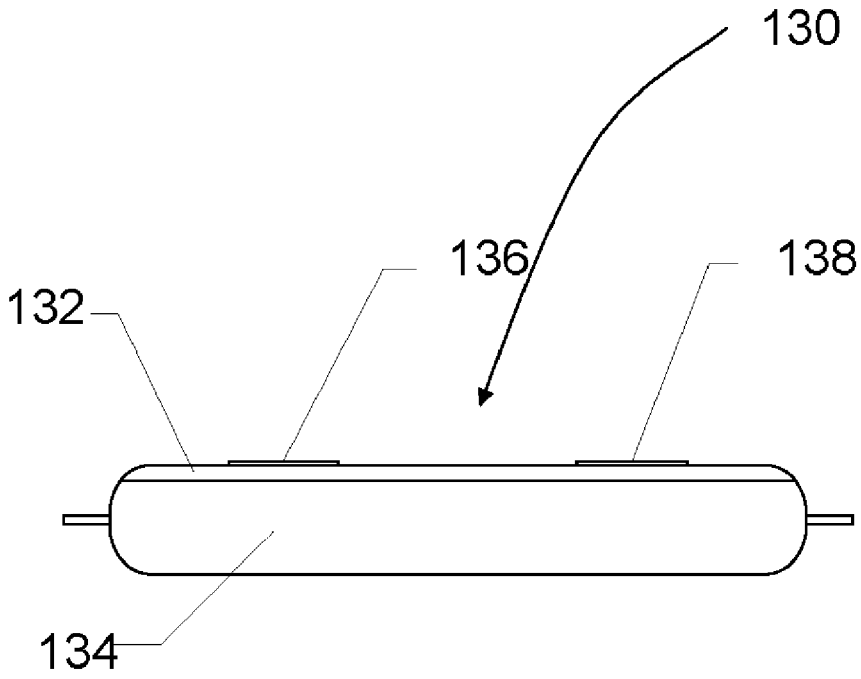
FIG. 8 shows a bladder of another embodiment of the present invention in cross-section.

Referring to FIG. 8 there is shown another embodiment of the bladder (130). In this embodiment a higher density foam layer (132) is laminated to the lower density foam (134) on the side where the VELCRO® strips (136) and (138) or other fastening means are mounted. The higher density foam provides a stable area over which the VELCRO® strips or other fastening means are mounted thereby improving the stability of the bladder once it is fixed to the belt as described below. The higher density foam will reduce distortions caused by the belt and the adjacent body and will serve to improve the focus of the pressure deeper into the body to reach smooth muscles. The high density layer (132) may also be made of other materials that have a significantly higher durometer than the foam layer (134) which presses against the body.

Figure 9A:
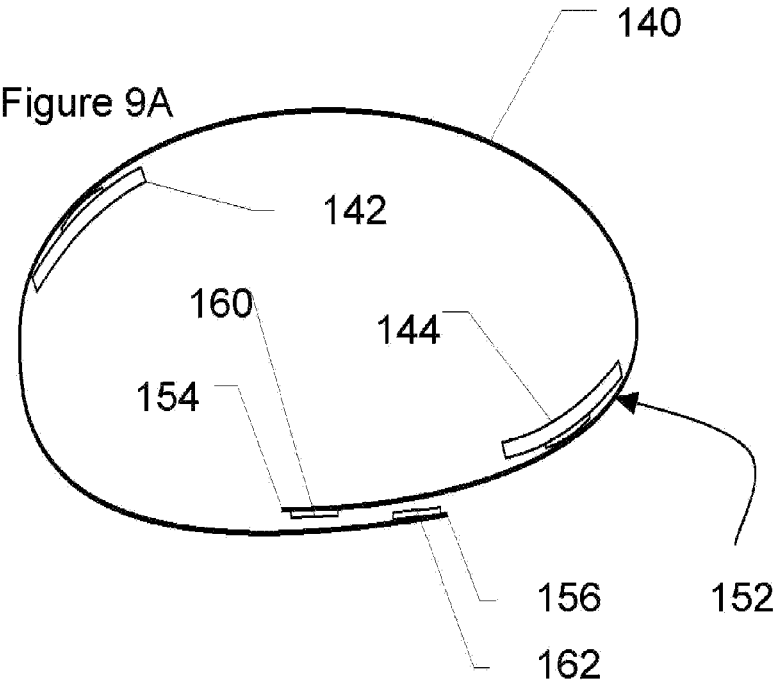
FIGS. 9A to 9C show the belt of the preferred embodiment of the present invention.
Figure 9B:
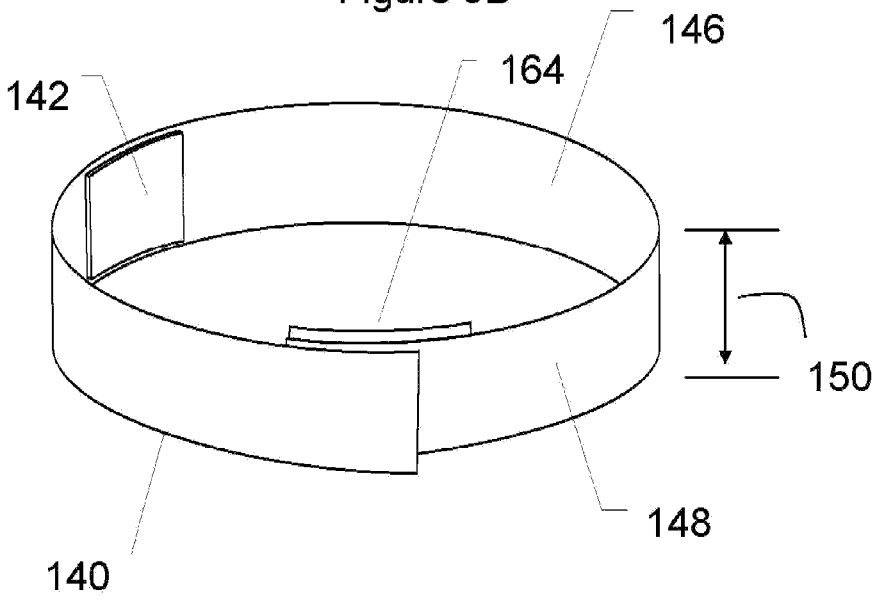

Referring now to FIG. 9A and FIG. 9B, there is shown a belt (140) adapted to be wrapped around the body of the individual and receive a first (142) and a second (144) bladder in therapeutically effective positions. The belt (140) has an inside surface (146) and an outside surface (148) and generally varies in length between 30 and 150 centimeters and in width (150) from 6 to 30 centimeters. However, when necessary other lengths and widths can be used. The belt inside surface is adapted to provide a resisting force on the belt side (152) of the inflating bladder so that all of the pressure is directed uniformly towards the body of the individual. One advantage of the belt over a vest is that the belt can be wrapped around various locations of the body such as limbs and torso to provide a therapeutic muscle massage to specific muscles. Another advantage of the belt over a vest is that the belt is more comfortable than a vest, less intrusive and permits precise application of massage therapy to the body.

The belt has a first end (154) and a second end (156). The inside (146) and outside (148) surfaces of the belt are made from a material that is soft with a minimum amount of stretch. Surfaces (146) and (148) are covered with VELCRO® loops. To fix the belt into a loop around the torso or limb of an individual there is a pair of VELCRO® hook patches (160) and (162) proximate to outside surface first end and inside surface second end respectively. The hook patches are rectangular and have a similar width to the belt. They are about 4 centimeters in length. The hook patches are adapted to engage the loop surfaces on the inside and outside surfaces of the belt in order to fix the belt in any desired position around the individual.

Figure 9C:
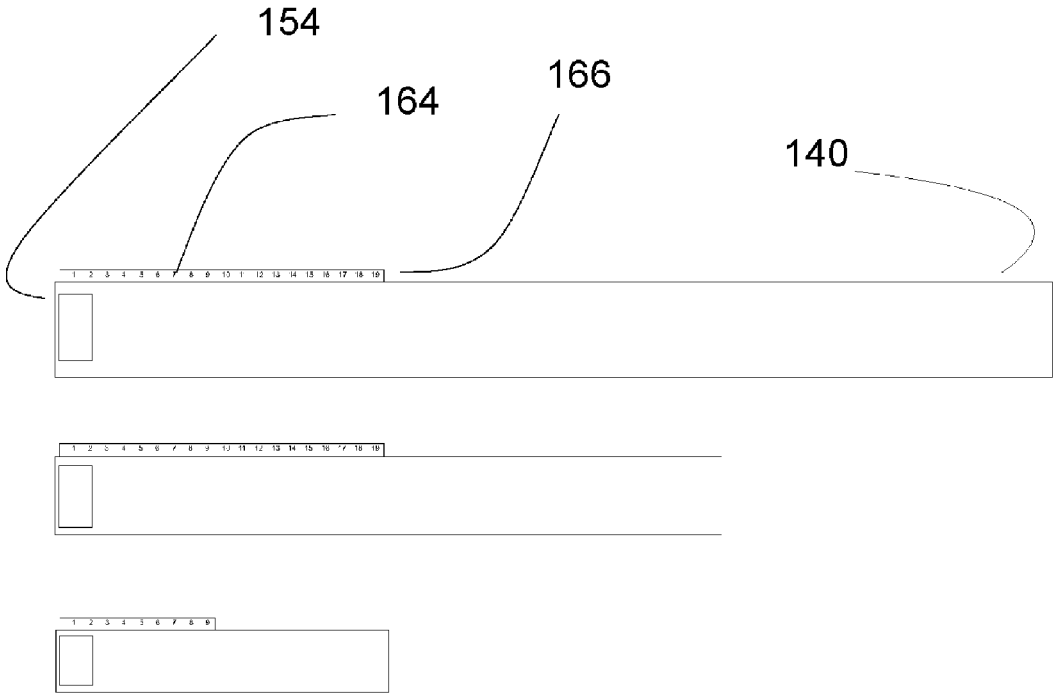

Referring to FIGS. 9B and 9C, a label (164) is affixed to the belt (140) proximate to the second end of the belt (154). The label has a series of sequential numbers (166). When the belt is applied to the body the first end of the belt overlaps the label at a specific location which can be identified by the adjacent number. By always aligning the belt end with the same number the belt may be placed repeatedly on the same location on the body with similar force being applied to that location on every application. Maintaining consistent placement of the bladders with consistent pressure and cycling those bladders in a consistent way ensures the whole massage is repeatable and well controlled. Bladders (142) and (144) are adapted for placement on the inner surface (146) of the belt using their respective VELCRO® hook strips meshing with the loops on the inside surface belt. To facilitate the placement of the bladders on the belt for maximum therapeutic effectiveness the bladders may be easily removed and repositioned on the belt so that they press against the same place on the body each time a massage is carried out. FIG. 9C illustrates different lengths of the same embodiment for either placement around the torso or limbs of individuals.

System Control

Figure 10:
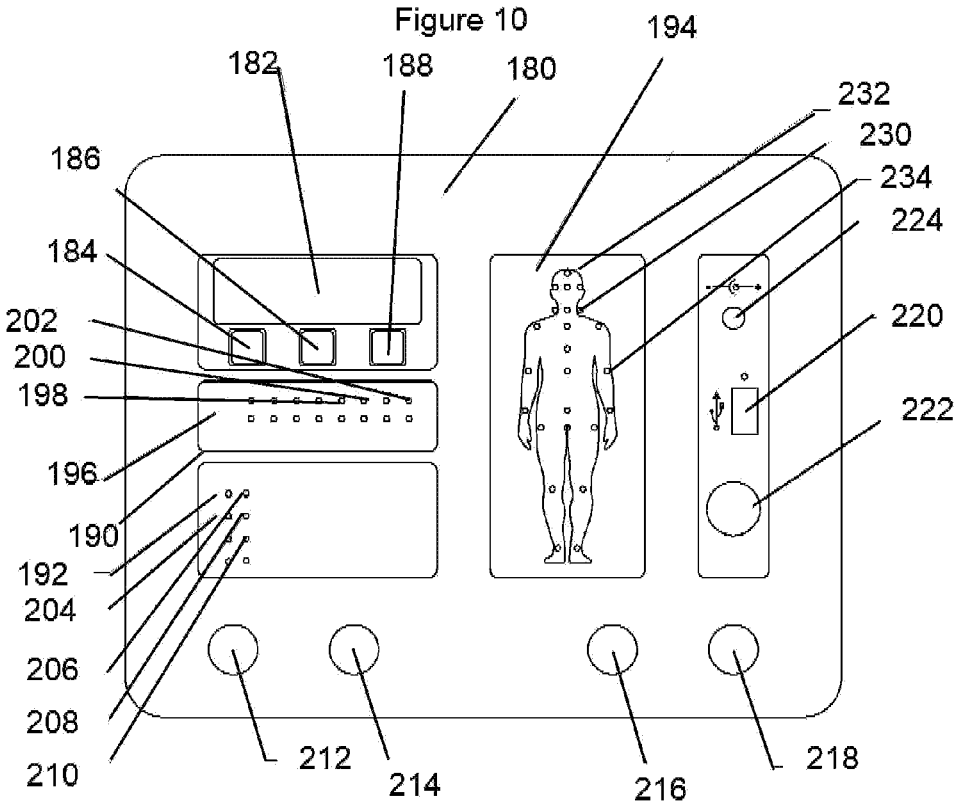
FIG. 10 shows the control consol of a preferred embodiment of the present invention.

Referring to FIG. 10 there is illustrated the control consol (180) of the preferred embodiment of the present invention. The preferred embodiment of the invention is designed to operate in a home-care situation by a non-professional care giver with minimal training. Therefore, there are no programming inputs into the control consol by the care giver. The consol is designed to provide sufficient information to the care-giver delivering the massage to accurately execute the prescription. The programming of the controller with the massage program is done by a professional, such as a therapist, on a dynamic prescription basis at a suitable facility. The programming parameters include at least the following: locations of massage on the body; number of pressure cycles at each location; maximum and minimum bladder pressures during each cycle; the duration of maximum and minimum pressures during each cycle; (alternatively) the pressure profile used to reach maximum or minimum pressures (such as linear, exponential, logarithmic or complex-polynomial ramps); the amount of time that pressure cycles are to be applied to a specific location on the body; the sequence of body locations that are to receive massage in a given set; the number of repeated sets in a massage session; the number of sessions in a day; the number of days in a given prescription. For example, a prescribed massage regime might comprise the following instructions to be programmed into the device:

Day: Monday

Set body locations: neck, shoulders, elbows, wrists in sequence;

Number of cycles per set: 4 at each location. Hold max pressure at 90 mm Hg. for 30 seconds. Hold min pressure at 10 mm Hg. for 10 seconds;

Four sets per session;

Four sessions per day with four hour intervals;

Prescription to have duration of 30 days.

Once a prescription period is terminated the device program will lock out the care-giver and will not perform any further massage regardless of attempted inputs by the care-giver. When the prescription expires the care-giver will be prompted to return the device to the originating facility and, if necessary, schedule a reassessment of the treatment protocol. The treatment protocol is reviewed and modified as necessary and the device reprogrammed for prescription duration. New prescriptions can be programmed into the device remotely over the telephone and Internet or through the mail using a flash memory device that can be inserted into the control panel USB port. This may also facilitate remote examination and reassessment of the individuals by a number of virtual methods including video conferencing, family doctor or care giver reports.

Compliance with the pre-programmed and prescribed treatment regime is critical to the success of the massage therapy. Care givers may feel that extra massage time will improve the individual's health. The system protects against over zealous application of the massage by disabling system functionality outside of the prescribed duration, repetition and application period as determined by the professional.

Compliance with the treatment regime can also suffer from under-application of the massage. In this case the care giver may elect to skip one or more massage sessions. In the case of the occasional skipped session the unit will continue to operate. Upon skipping too many sessions the professional may set the unit prescription to expire early forcing the caregiver to reveal their non-compliance to the professional.

Each system will contain an embedded serial number and other unique identifiers that ensure only a prescription designated for that system may be loaded into the system. The system will also contain a real-time clock that cannot be modified by the care giver. The clock will be updated automatically during prescription loading and may be checked to ensure an expired prescription is not reloaded into the unit.

The system will also log a significant amount of information relating to the application of the massage, compliance to the program, and may also record system parameters such as total operating time and temperature.

Still referring to FIG. 10 the control panel (180) display comprises a display screen (182) to display information to the care-giver such as pressure within the bladders in p.s.i or mm Hg, a countdown feature during various stages of the massage to inform the care-giver of the time of maximum or minimum pressures for each cycle, on/off functions, self-test functions, instructional messages and massage program selection such as head, torso or limbs, or Monday, Tuesday, Wednesday etc. The display screen is generally a 4 line 20 character display and is STN transflective. The display is LED and backlit in yellow/green. Below the display screen are located three push buttons (184), (186) and (188) which are preferably lit to facilitate operation in a dark room such as a bedroom. The unit may be used at night while the individual is sleeping and therefore all operations are as quiet as possible and all indicators and backlighting tend to be dim. The functions of the buttons may vary, but generally, button (184) can have an on/off function, button (186) can be a program selection button and button 188 can be a program execute button or an emergency shut-off button (Item 45—FIG. 1). The buttons can also be programmed to respond to instructions given to the care-giver on the LED display panel. For example, the display may have the message "Bladders in place? Press 1 for YES and 2 for NO". The operator would then press the appropriate button. The control consol also includes three LED-type displays: a pressure display (190), an operational display (192) and a body silhouette display (194). Pressure display (190) comprises a plurality of color LEDs (196) adapted to visually display the pressure in the bladders. The display would, for example, show pressure from minimum to maximum therapeutic pressure as, for example, red LED (198) to yellow LED (200) to green LED (202). In normal use only the green LED indicators should light. If the bladders are abused such as the person rolling on them, or if the conduits connecting the bladders to the device become blocked during inflation, then the pressure indicators may approach the yellow or red regions indicating there is a problem. An audio alarm function may also be included to alert the care-giver if the pressure display is not being monitored. The operational display (192) comprises a group of four LEDs (204) to indicate to the operator the status of the massage cycle, namely, the bladders are inflating (206), deflating (208) or holding at their inflated pressure for the prescribed period of time (210).

At the start of a massage set and once the prescribed program has been initialized by the care-giver, the appropriate LED on the body silhouette display (194) will illuminate and flash to cue the care-giver to place the bladders in the required locations on the body. The bladders will be deflated to maximum negative pressure so that they are easily placed on the body and fixed in place with the belt. Display (182) will give specific written instructions to the placement of the bladders. Alternatively, the instructions can be given verbally by way of the speaker (222). Once the bladders are placed the operator would push, for example, button (188) in response to a query on the display (182) confirming the bladders are properly placed and the next phase of the treatment cycle can commence. The set begins and the body silhouette LEDs 230 (neck), 232 (head) and 234 (arm) will illuminate in a sequential manner according the programmed massage protocol to instruct the home care-giver where to place the massage bladders. Once the session of sets is finished for a particular part of the body, the display (182) will indicate to the operator that a particular session is completed and that the belt and bladders can be move to a different body location. In other embodiments of the invention the body silhouette display may have both front and rear body forms.

The embodiment of the control consol in FIG. 10 further includes attachments (212), (214), (216) and (218) for up to two independent sets of bladders each having two air fittings. Therefore, on the left side of the control panel, bladder pair A would be connected to fittings (212) and (214) and bladder pair B would be connected to fittings (216) and (218). This would be termed a dual-channel unit. A single channel unit would perform only one massage on one part of the body at a time. A dual channel unit is like combining two single channel units together and will allow either two completely independent massages to take place or it can allow two complementary massages to take place that have different pressure profile requirements. For example it may be desirable to place a large bladder on the front of the chest and the back of the individual, while placing two smaller bladders under each arm, but all focused on the center of the body. These bladder pairs would require different pressure profiles, but may require time synchronization of their actions. All sequences of two-channel operation are programmable.

There is no limit to the number of channels that could be integrated into a single unit, or to the number of bladders that each channel would support. It is also conceived that multiple units could be networked together to perform a synchronized massage on a single individual or that a single massage unit with multiple bladders could perform massages simultaneously on different individuals.

USB port (220) is used to program the microprocessor with the treatment prescription either at a medical facility, over the Internet, or using any other storage and downloading medium including but not limited to wireless keys, media drives, single use storage, radio frequency identification (RFID) and volatile random access memory. An speaker (222) may be included to indicate when the cycles are finished or to indicate a fault in the system. A power input receptacle is located in the upper right corner of the control panel at (224).

The control system used to control the various components of our invention is well known in the art and need not be described here. Our preference is for the Texas Instruments MSP430 programmable microcontroller which is adapted to receive and transmit operational data from the various components of the system such as the pumps, valves, LEDs, alarms and pressure sensors. If necessary, the microprocessor will interface with an A/D converter in order to receive data from an analog pressure sensor.

System Programming

Programming of the microprocessor is done via a computer terminal that is attached to the microprocessor by way of the USB port (220). The steps undertaken to program the device are: (i) providing a facility including professionals skilled in therapeutic massage; (ii) placing a living human body in need of therapeutic massage in association with the professionals; (iii) assessing the therapeutic massage needs of the body by the professionals; (iv) determining the sites of therapeutic massage on the body with reference to the body silhouette having a plurality of massage sites indicated thereon and the sequence of the sites of to receive therapeutic massage; (v) programming the results of step (iv) into the programmable controller; (vi) determining the number of pressure cycles to be applied at each of the sites of therapeutic massage; (vii) determine the maximum and minimum pressures for each pressure cycle and the pressure profiles used to achieve those pressures; (viii) determine the duration of maximum and minimum pressures for each pressure cycle; (ix) programming the results of steps (vi), (vii) and (viii) into the programmable controller; (x) determining the number of pressure cycles comprising a set of pressure cycles at each of the sites of therapeutic massage; (xi) determining the number of sets to be applied at each of the sites of therapeutic massage; (xii) determining the number of sets comprising a session of therapeutic massage; (xiii) determining the number sessions per day to be applied to the body; (xiv) programming the results of steps (x), (xi) and (xii) into the programmable controller; (xv) determining the number of days comprising a prescription; (xvi) programming the results of set (xv) into the programmable controller; (xvii) programming the programmable controller to cease device operation at the expiry of the prescribed number of days; and, (xviii) programming the programmable controller to notify the operator to return the device to said facility.

Although the description above contains much specificity, these should not be construed as limiting the scope of the invention but as merely providing illustrations of some of the presently preferred embodiments of this invention. Thus the scope of the invention should be determined by the appended claims and their legal equivalents.

What is claimed is:

1. A portable and remotely programmable automated massage therapy device for biomechanical rehabilitation massage of smooth muscles and their related myofascia of a cerebral palsy patient, said device comprising at least one inflatable bladder for pressure application to said patient, said at least one inflatable bladder having a single inflation/deflation port, wherein the at least one inflatable bladder is adapted to be temporarily fixed to the patient at a therapeutically predetermined massage location by an adjustable belt and has a shape adapted to meet the contour of said therapeutically predetermined massage location, a pressurizing pump for controlled and gradual inflation of the at least one bladder over a first plurality of seconds to a first therapeutically effective pressure, a needle orifice for maintaining said first therapeutically effective pressure for a second plurality of seconds, a vacuum pump for controlled and gradual deflation of the at least one bladder over a third plurality of seconds to a second therapeutically effective pressure, said needle orifice for maintaining said second therapeutically effective pressure for a fourth plurality of seconds, a remotely programmable controller for applying said automated massage therapy, said controller having a data port for receiving digital programming for a treatment protocol prescribed by a remote medical professional wherein said digital programming is delivered to the patient by communication means, downloaded to the device by said data port and executed by the controller, the digital programming rendering the device inoperative upon completion of said prescribed treatment protocol in order to prevent over treatment of the patient and a control consol for displaying a plurality of operating parameters and operating instructions to a care-giver for execution of the treatment protocol.

2. The device as claimed in claim 1, wherein the treatment protocol comprises a therapeutically determined plurality of controlled and gradual inflation and deflation cycles of the at least one bladder at a therapeutically predetermined plurality of massage locations on the patient for a therapeutically predetermined amount of time.

3. The device as claimed in claim 2, wherein the at least one inflatable bladder comprises a set of two inflatable bladders for simultaneous massage at two massage locations.

4. The device as claimed in claim 3, wherein the at least one inflatable bladder comprises two sets of two inflatable bladders for simultaneous massage at four massage locations.

5. The device as claimed in claim 1, wherein said pressurizing pump is connected to said inflation/deflation port and a first solenoid operated inflation control valve having an open position and a closed position disposed between the pressurizing pump and the inflation/deflation port, wherein the operation of the pressurizing pump and the first solenoid operated inflation control value is controlled by said programmable controller.

6. The device as claimed in claim 5, wherein said needle orifice is disposed between the at least one bladder inflation/deflation port and the vacuum pump, wherein said needle orifice acts as a flow limiting valve to allow pressurized air to escape the at least one bladder.

7. The device as claimed in claim 6 wherein said vacuum pump includes an intake connected to the inflation/deflation port, and wherein operation of the vacuum pump is controlled by the programmable controller.

8. The device as claimed in claim 7 wherein the at least one inflatable bladder comprises an internal foam core sealed within and uniformly connected to an air-tight hybrid cloth and plastic material thereby causing the bladder to undergo a uniform change in thickness over its entire operating area as it is inflated and deflated.

9. The device as claimed in claim 8 wherein said internal foam core comprises a soft layer of foam laminated to a harder layer of foam so that the at least one bladder undergoes a uniform change in thickness as it inflates to a positive working pressure of plus 100 mm Hg and deflates to a negative working pressure of minus 100 mm Hg thereby providing a piston-like motion for focusing pressure deep within the patient in order to act against smooth muscle and myofascia, and wherein the soft layer of foam is pliable for comfort and placed to face a body portion of the patient and said harder layer of foam is placed to face said inside surface of the belt.

10. The device as claimed in claim 1, wherein said remotely programmable controller programs the device with the prescribed treatment protocol and executes the prescribed treatment protocol.

11. The device as claimed in claim 10, wherein the programmable controller includes an embedded and unique patient identifier adapted to ensure that only a prescription designated for that patient may be loaded into the programmable controller of the device.

12. The device as claimed in claim 11 wherein the programmable controller further includes a real-time-clock adapted to render the device inoperable outside of the operating time limits described in the prescribed treatment protocol; and, further wherein said real-time clock combined with a memory renders the device inoperable when a prescribed amount of therapy during a predetermined time period has been exceed thereby preventing a therapeutic overdose.

13. The device as claimed in claim 12 wherein the programmable controller further includes a memory for recording previously executed treatment protocols so that a medical professional can review said executed treatment protocols for compliance to a prescribed treatment.

14. The device as claimed in claim 13 wherein the programmable controller is programmable with the treatment protocol comprising at least the following parameters: locations of massage on the patient's body, sequence of locations for massage, number of pressure cycles at each location, maximum and minimum bladder pressures at each location, duration of each maximum and minimum pressure, the pressure profile used to reach maximum and minimum pressure, the number of sequences in a given therapy session and the number of therapy sessions in a day.

15. The device as claimed in claim 1, wherein said control consol is adapted for providing the care giver with instructions on the proper massage location of the at least one inflatable bladder during execution of the treatment protocol by including a human silhouette having a plurality of light emitting diodes for displaying massage locations in a sequential manner in accordance with the prescribed treatment protocol.

16. The device as claimed in claim 15, where said control consol includes a speaker for providing audible instructions to the care-giver, wherein said audible instructions are coordinated with massage location displays on said human silhouette.

* * * * *